US005762729A

United States Patent [19]

Nishikawa et al.

[11] Patent Number: 5,762,729

[45] Date of Patent: Jun. 9, 1998

[54] ALUMINUM ALLOY SUBSTRATE FOR LITHOGRAPHIC PRINTING PLATE AND PROCESS OF PRODUCING SAME

[75] Inventors: Yasuhisa Nishikawa; Hideki Suzuki, both of Ihara-gun; Hirokazu Sakaki; Yoshinori Hotta, both of Haibara-gun, all of Japan

[73] Assignees: Nippon Light Metal Company Ltd., Tokyo; Fuji Photo Film Company Ltd., Kanagawa, both of Japan

[21] Appl. No.: 826,299

[22] Filed: Mar. 27, 1997

Related U.S. Application Data

[63] Continuation of Ser. No. 296,113, Aug. 25, 1994, abandoned.

[30] Foreign Application Priority Data

Aug. 31, 1993 [JP] Japan ..... 5-237153
Aug. 19, 1994 [JP] Japan ..... 6-195352

[51] Int. Cl.[6] ..... C22F 1/04

[52] U.S. Cl. ..... 148/551; 148/552; 148/693; 148/697; 148/698

[58] Field of Search ..... 148/551, 552, 148/693, 697, 698, 699

[56] References Cited

U.S. PATENT DOCUMENTS 5,078,805 1/1992 Uesugi et al. ..... 148/437
5,186,767 2/1993 Rooy et al. ..... 148/552

FOREIGN PATENT DOCUMENTS 0 158 941 10/1985 European Pat. Off. .
0 223 737 5/1987 European Pat. Off. .
0 289 844 11/1988 European Pat. Off. .
0 415 238 3/1991 European Pat. Off. .
60-0158941 10/1985 Japan .
3-79798 4/1991 Japan .
5-156414 6/1993 Japan .
89/12114 12/1989 WIPO .

OTHER PUBLICATIONS

Patent Abstract of Japan, Oct. 1991, vol. 15, No. 425, (C–0879) #03 177 529, Aug. 1, 1991 (Sky Alum Co., Ltd.).

Patent Abstract of Japan, Apr. 1987 vol. 11, No. 136, (C–419), #61–272 357, Dec. 1, 1986 (Sukai Alum KK).

*Primary Examiner*—George Wyszomierski
*Attorney, Agent, or Firm*—McAulay Fisher Nissen Goldberg & Kiel, LLP

[57] ABSTRACT

A continuously cast and rolled aluminum alloy substrate for an electrolytically grainable lithographic printing plate, consisting of 0.20 to 0.80 wt. % of Fe and the balance of Al, grain-refining elements and unavoidable impurities including 0.3 wt. % or less of Si and 0.05 wt. % or less of Cu, the amount of Fe present in solid solution being not more than 250 ppm, the amount of Si present in solid solution being not more than 150 ppm, and the amount of Cu present in solid solution being not more than 120 ppm.

13 Claims, No Drawings

ALUMINUM ALLOY SUBSTRATE FOR LITHOGRAPHIC PRINTING PLATE AND PROCESS OF PRODUCING SAME

This is a continuation, of application Ser. No. 08/296, 113, filed Aug. 25, 1994 now abandoned.

BACKGROUND OF THE INVENTION

1. Field of the Invention

The present invention relates to an aluminum alloy substrate for a lithographic printing plate having a good electrolytic graining property and to a process of producing same.

2. Description of the Related Art

Conventional aluminum alloy substrates for a support for a lithographic printing plate are generally provided in the form of a 0.1 to 0.5 mm thick cold-rolled sheet made of an aluminum alloy such as JIS A1050, A1100, A3003, or the like. Such aluminum alloy cold-rolled sheets are generally produced by machining the surface of a semicontinuous-cast (DC) slab or billet, homogenization heat-treating the billet when necessary, heating the billet to a selected temperature, hot-rolling the heated billet to a hot-rolled strip, cold-rolling the hot-rolled strip with an intermediate annealing between the cold rolling passes, and final cold rolling the strip to a cold-rolled sheet.

Japanese Unexamined Patent Publication (Kokai) Nos. 3-79798 and 5-156414 disclosed a process of producing an aluminum alloy support for a lithographic printing plate, in which an aluminum alloy melt is continuously cast and rolled to form a strip, which is not homogenized but is subjected to cold rolling, heat treatment, and straightening.

The aforementioned conventional process using a DC slab or billet has drawbacks in that the process steps are complicated and take much time, the production cost is high, the casting speed is slow, the rolling and heat treatment conditions are strict, and heat treatments must be carried out many times, and the process cannot provide an aluminum alloy support with stable properties, particularly a good electrolytic graining property.

The process disclosed in Japanese Unexamined Patent Publication (Kokai) Nos. 3-79798 and 5-156414 also has drawbacks in that, although a continuous casting and rolling process is used, the support does not provide a sufficiently uniform surface when electrolytically grained and fails to have a satisfactory press life and that heat treatments are not conducted under suitable conditions.

SUMMARY OF THE INVENTION

An object of the present invention is to provide a continuously cast and rolled aluminum alloy substrate for a lithographic printing plate having a uniform surface, when electrolytically grained, and a good press life.

To achieve the object according to the first aspect of the present invention, there is provided a continuously cast and rolled aluminum alloy substrate for an electrolytically grainable lithographic printing plate, consisting of 0.20 to 0.80 wt % of Fe and the balance of Al, grain-refining elements and unavoidable impurities including 0.3 wt % or less of Si and 0. 05 wt % or less of Cu, the amount of Fe present in solid solution being not more than 250 ppm, the amount of Si present in solid solution being not more than 150 ppm, and the amount of Cu present in solid solution being not more than 120 ppm.

Another object of the present invention is to provide a process of producing the above-mentioned aluminum alloy substrate, having an industrial advantage in that the process steps are simplified and the processing cost and time are reduced.

To achieve the object according to the second aspect of the present invention, there is provided a process of producing an aluminum alloy substrate for an electrolytically grainable lithographic printing plate, the process comprising the steps of:

preparing a melt of an aluminum alloy consisting of 0.20 to 0.80 wt % of Fe and the balance of Al, grain-refining elements and unavoidable impurities including 0.3 wt % or less of Si and 0.05 wt % or less of Cu;

continuously casting and rolling the melt to form a strip having a thickness of 20 mm or less;

cold-rolling the cast strip, with or without preceding hot rolling, to form a cold-roll sheet, at a total reduction in thickness of 50% or more, with a heat treatment at a temperature of not lower than 200° C. but lower than 400° C. effected either between passes of the cold rolling or after completion of the cold rolling so that the cold-rolled sheet has an amount of Fe in solid solution of not more than 250 ppm, an amount of Si in solid solution of not more than 150 ppm, and an amount of Cu in solid solution of not more than 120 ppm.

Preferably, the heat treatment is effected at a temperature of not lower than 250° C. but lower than 350° C.

Also preferably, the heat treatment is effected for 2 hours or longer.

To achieve the object according the third aspect of the present invention, there is provided a process of producing an aluminum alloy substrate for an electrolytically grainable lithographic printing plate, the process comprising the steps of:

preparing a melt of an aluminum alloy consisting of 0.20 to 0.80 wt % of Fe and the balance of Al, grain-refining elements and unavoidable impurities including 0.3 wt % or less of Si and 0.05 wt % or less of Cu;

continuously casting and rolling the melt to form a cast strip having a thickness of 20 mm or less;

cold-rolling the cast strip, with or without preceding hot rolling, to form a cold-roll sheet, at a total reduction in thickness of 91% or more, with a heat treatment at a temperature of 400° C. or higher effected between passes of the cold rolling or after completion of the cold rolling so that the cold-rolled sheet has an amount of Fe in solid solution of not more than 250 ppm, an amount of Si in solid solution of not more than 150 ppm, and an amount of Cu in solid solution of not more than 120 ppm.

Preferably, the heat treatment is effected for 2 hours or longer.

The present inventors made a number of studies for solving the problems of the above-recited conventional technologies and found that the uniformity of the electrolytically grained surface is improved when the support is produced by a continuous casting and rolling process and the amounts of Fe, Si, and Cu in solid solution are reduced as much as possible. Proper amounts of Fe, Si, and Cu in solid solution of the support are obtained by using proper heat treatment temperature and cold rolling reduction in thickness, as specified above.

To provide an aluminum alloy substrate or support suitable for an electrolytically grainable lithographic printing plate, the present invention uses a continuous casting and rolling process, the specified chemical composition, and the specified solid solution Fe, Si, and Cu amounts, for the reasons described in detail below.

The continuous casting and rolling process provides a high speed solidification and a fine and uniform dispersion of crystallized particles, thereby eliminating the necessity of the homogenization heat treatment required for DC-cast slabs. The absence of a lengthy treatment ensures a stable quality suitable as a substrate for a support.

The Fe content must be within the range of from 0.20 to 0.80 wt %. Fe must be present in an amount of 0.20 wt % or more in order to ensure an improved mechanical strength and must not be more than 0.80 wt % in order to prevent precipitation of Al—Fe intermetallic compounds in the form of coarse particles reducing the uniformity of pits formed by electrolytic graining. The Fe content is preferably not more than 0.50 wt %.

Si is found in aluminum alloys as an impurity element and must not be present in an amount of more than 0.3 wt % because, when present in a larger amount, it reduces the uniformity of the electrolytically grained surface.

Although Cu is also an impurity element found in aluminum alloys, Cu is preferably present in an amount of 0.001 wt % or more because it facilitates uniform electrolytic graining. However, Cu present in an excessive amount causes formation of coarse pits during electrolytic graining and reduces the uniformity of electrolytic graining. Therefore, the Cu content must not be more than 0.05 wt %, and preferably not more than 0.03 wt %.

The grain refining elements may be present in the aluminum alloy according to the present invention to prevent the occurrence of cracking during casting. For example, 0.01 to 0.04 wt % Ti or 0.0001 to 0.02 wt % B may be present to this end.

It is preferable that the ratio Cu/Ti, i.e., the ratio of the solid solution Cu amount to the solid solution Ti amount, is not greater than 1, in order to stabilize the electrolytic graining to provide a uniform electrolytically grained surface.

Other impurities such as Mg, Mn, Cr, Zr, V, Zn, and Be may be occasionally present and are considered harmless when present in a trace amount of less than about 0.05 wt %.

The solid solution Fe, Si, and Cu amounts must not be more than 250, 150, and 120 ppm, respectively. These limitations are necessary to ensure that uniform pits are formed by electrolytic graining, because the solid solution Fe, Si, and Cu present in excessive amounts cause the formation of coarse pits greater than 10 μm in diameter in an electrolytically grained surface, reducing water retainability, causing ink stains, and reducing the press life of the printing plate.

The aluminum alloy substrate of the present invention is preferably produced by the following procedures, to which the present invention is not limited.

The present invention uses any continuous-strip-casting method, selected from the Hunter method, the 3C method, the Hazelett method, and the belt casting method, to form a strip having a thickness of 20 mm or less, which is then preferably coiled to form an aluminum alloy strip coil. This casting method involves quench-solidification from an aluminum alloy melt, so that alloying elements are kept sufficiently in solid solution and fine particles of second phases are crystallized. This phenomenon is particularly remarkable when the strip thickness is not more than 20 mm. When a strip has a greater thickness, the number of the subsequent rolling passes must be increased and thereby the productivity is reduced.

An aluminum alloy melt is continuously cast and rolled to a strip having a thickness of 20 mm or less and coiled, which is then cold-rolled, without a homogenization heat treatment, to an aluminum alloy substrate having a predetermined thickness. When a proper heat treatment is not effected between the rolling passes or after the final rolling pass, or when a proper strain is not given by the cold rolling before the heat treatment, the electrolytic graining does not provide a uniform pit size, reducing the water retainability and the press life of the printing plate.

Therefore, to ensure a uniform electrolytic graining, a proper strain is given by the cold rolling and a proper heat treatment is then performed to cause supersaturated Fe, Si, and Cu to precipitate as fine second phase particles and thereby reduce the amounts of the supersaturated Fe, Si, and Cu in solid solution to amounts of not more than 250 ppm, 150 ppm, and 120 ppm, respectively.

The proper strain is 50% or more given by cold rolling before the heat treatment and the proper heat treatment is carried out at a temperature of not higher than 400° C., preferably of 350° C. or lower, and 200° C. or higher, preferably 250° C. or higher.

These combined strain and heat treatment conditions ensure that the amount of Fe in solid solution is not more than 250 ppm, the amount of Si in solid solution is not more than 150 ppm, and the amount of Cu in solid solution is not more than 120 ppm, thereby preventing the formation of the large pits having a diameter of 10 μm or more and providing an aluminum alloy substrate for a lithographic printing plate having a uniform pit size formed by electrolytic graining.

According to the third aspect of the present invention, when the cold rolling before the heat treatment is performed at a large reduction in thickness of 91% or more, preferably 93% or more, to give a proper strain to the strip, the heat treatment may be carried out at a temperature of 400° C. or higher, not lower than 400° C., because the precipitation of the supersaturated elements is promoted by an increased strain given by the large reduction in thickness. The upper limit of the heat treatment temperature is considered to be about 550° C. from the viewpoint of the dissolution temperatures of the second phase particles.

The heat treatment is effected either between passes of the cold rolling or after the final cold rolling.

Preferably, the heat treatment conditions are determined with respect to the mechanical strength of a final product sheet and considering that the amount of Fe in solid solution is reduced when a larger strain is given by the cold rolling before the heat treatment.

The heat treatment may be carried out in a batch-type heat treatment furnace. In this case, an aluminum alloy sheet coil is heated at a heating rate of 100° C. /hr or less. Holding time at a predetermined temperature varies with the predetermined temperature, i.e., the holding time is long at a low temperature and is short at a high temperature. The holding time is generally in the range of from 1 to 6 hours, and is preferably 2 hours or more.

DESCRIPTION OF THE PREFERRED EMBODIMENTS

Table 1 summarizes the chemical compositions of the aluminum alloys A and C according to the present invention and of the comparative alloys B and D having an excessive Cu content of 0.07 wt % and an excessive Fe content of 1.2 wt %, respectively, both exceeding the specified upper limits of the present invention.

TABLE 1

| Alloy | Si | Fe | Cu | Ti | Mn | (wt %) B |
|---|---|---|---|---|---|---|
| A | 0.082 | 0.28 | 0.016 | 0.014 | 0.028 | 0.002 |
| B | 0.13 | 0.45 | 0.07 | 0.020 | 0.020 | 0.002 |
| C | 0.07 | 0.41 | 0.007 | 0.010 | 0.004 | <0.001 |
| D | 0.20 | 1.2 | 0.02 | 0.020 | 0.020 | 0.002 |

Regarding alloys A and B, a Hunter continuous casting and rolling machine was used to produce a coil of an aluminum alloy strip having a thickness of 7 mm, which was then processed under the conditions shown in Table 2 to provide, as a final product, an aluminum alloy substrate having a desired thickness for a lithographic printing plate.

Regarding alloys C and D, a belt caster type continuous casting and rolling machine was used to produce a coil of an aluminum alloy strip having a thickness of 15.8 mm, which was then hot-rolled to a thickness of 1.5 mm, which was then processed under the conditions shown in Table 2 to provide, as a final product, an aluminum alloy substrate having a desired thickness for a lithographic printing plate.

TABLE 2

| No. | Al-loy | Cold Rolling (mmt) | Inter. *1 Anneal. (°C. × hr) | Cold Rolling (mmt) | Final Anneal. (°C. × hr) | Re-duc-*2 tion (%) | Re-*3 marks |
|---|---|---|---|---|---|---|---|
| 1 | A | — | — | 0.3 | — | — | C |
| 2 | A | 3.0 | 300 × 2 | 0.3 | — | 57 | I |
| 3 | A | 0.9 | 300 × 2 | 0.3 | — | 87 | I |
| 4 | A | 0.9 | 400 × 2 | 0.3 | — | 87 | C |
| 5 | A | 3.0 | 500 × 4 | 0.3 | — | 57 | C |
| 6 | A | — | — | 0.3 | 260 × 4 | 96 | I |
| 7 | B | 3.0 | 180 × 1 | 0.2 | — | 57 | C |
| 8 | C | — | — | 0.3 | — | — | C |
| 9 | C | 0.7 | 300 × 2 | 0.3 | — | 53 | I |
| 10 | D | 0.7 | 300 × 2 | 0.3 | — | 53 | C |
| 11 | A | 0.5 | 500 × 2 | — | — | 93 | I |

*1) Intermediate annealing.
*2) Reduction in thickness given before heat treatment.
*3) I: Invention, C: Comparison.

Regarding the thus-produced inventive and comparative aluminum alloy substrates, the mechanical properties, the amounts of Fe, Si, and Cu in solid solution, and the electrolytic graining property or press life were summarized in Table 3, in which the latter two were determined in the following manners, respectively.

The amounts of Fe, Si, and Cu in solid solution were determined by the following phenol dissolution extraction method. Samples were dissolved in a heated phenol and mixed with benzyl alcohol. The mixture was then filtered through a polytetrafluoroethylene filter to remove the residue of intermetallic compounds. The filtered mixture was diluted with benzyl alcohol and the solid solution elements contained therein were extracted and quantitatively analyzed by a standard added ICP emission spectroanalysis.

The electrolytic graining property was determined by the following procedure. The aluminum alloy substrates were brush-grained in a pumice stone water suspension, alkali-etched, desmut-treated, and electrolytically grained in a 1% nitric acid by using a power supply providing an electrolytic waveform with alternating polarity at an anodic electricity quantity of 150 Coulomb/dm$^2$. The thus-treated substrates were cleaned in sulfuric acid and the surface was observed in a scanning electron microscope to evaluate the uniformity of the grained surface.

TABLE 3

| | Mechanical property | | | Solid solution *1 | | | | |
|---|---|---|---|---|---|---|---|---|
| No. | T.S. N/mm$^2$ | P.S. N/mm$^2$ | El. % | Fe ppm | Si ppm | Cu ppm | *2 Grain | *3 Remarks |
| 1 | 211 | 194 | 6.2 | 320 | 105 | 100 | X | C |
| 2 | 196 | 179 | 5.0 | 180 | 90 | 100 | ○ | I |
| 3 | 159 | 150 | 4.0 | 40 | 90 | 70 | ○ | I |
| 4 | 150 | 143 | 3.0 | 30 | 110 | 125 | Δ | C |
| 5 | 185 | 170 | 4.0 | 160 | 160 | 110 | X | C |
| 6 | 144 | 137 | 10.0 | 135 | 60 | 30 | ○ | I |
| 7 | 227 | 221 | 5.8 | 300 | 40 | 140 | X | C |
| 8 | 207 | 192 | 5.0 | 300 | 90 | 30 | X | C |
| 9 | 158 | 149 | 4.3 | 30 | 80 | 20 | ○ | I |
| 10 | 210 | 195 | 6.0 | 350 | 80 | 100 | X | C |
| 11 | 130 | 125 | 3.0 | 50 | 70 | 80 | ○ | I |

*1 Amount of element in solid solution.
*2 Electrolytic graining property
○: Uniform graining or pits. Unetched portion not found.
Δ: Few unetched portions found.
X: Many unetched portions or nonuniform graining.
*3 I: Invention, C: Comparison.

Table 3 shows that sample Nos. 2, 3, 6, 9, and 11 of the present invention had amounts of Fe, Si, and Cu in solid solution within the specified upper limits of not more than 250 ppm, 150 ppm and 120 ppm, respectively, and good electrolytic graining property.

It can be also seen from Table 3 that comparative samples 1 and 8, which were not heat-treated between or after cold rolling passes, had an amount of Fe in solid solution greater than the specified upper limit of 250 ppm and were nonuniformly grained.

Because comparative samples 4 and 5 were not properly heat-treated between cold rolling passes, comparative sample 4 had an amount of Cu in solid solution of slightly more than the specified upper limit of 120 ppm and had a few unetched portions remaining and comparative sample 5 had an amount of Si in solid solution of slightly more than the specified upper limit of 150 ppm and was nonuniformly electrolytically grained.

Comparative sample 7, which contained Cu in an amount of more than the specified upper limit of 0.05 wt % and was not properly heat-treated between cold rolling passes, had an amount of Fe in solid solution of greater than the specified upper limit of 250 ppm and was nonuniformly electrolytically grained.

Comparative sample 10, which contained Fe in an amount of greater than the specified upper limit of 0.8 wt % and also had an amount of Fe in solid solution of greater than the specified upper limit of 250 ppm, was nonuniformly electrolytically grained.

These results show that, to provide uniform electrolytic graining and thereby ensure a good press life of the printing plate, all of the specified features of the present invention must be satisfied.

As herein described, the present invention provides an aluminum alloy substrate for a lithographic printing plate having a uniform electrolytically grainable surface ensuring good press life upon printing. The present invention also provide a process of producing the aluminum alloy substrate, which has a great industrial advantage in that process steps are simplified to reduce the production cost and time.

We claim:

1. A process of producing an aluminum alloy substrate for an electrolytically grainable lithographic printing plate, said substrate capable of providing uniform graining or pits necessary for good printing quality using said plate, said process preventing the formation of large pits having a diameter of at least 10 μm in said plate and preventing occurrence of an unetched region, said process comprising the steps of:

preparing a melt of an aluminum alloy consisting of 0.20 to 80 wt % of Fe and the balance of Al, grain-refining elements and unavoidable impurities and further consisting of 0.3 wt % or less of Si and 0.05 wt % or less of Cu, said amounts of Fe, Si and Cu being limited to provide the uniform graining or pits necessary for good printing quality and preventing the formation of large pits having a diameter of at least 10 μm;

continuously casting and rolling said melt to form a strip having a thickness of 20 mm or less; and cold-rolling said strip, with or without a preceding hot rolling step, to form a cold-rolled sheet with a heat treatment at a temperature of no lower than 200° C. but lower than 400° C. effected either between passes of said cold rolling or after completion of said cold rolling and with a reduction in thickness of 50% or more given before said heat treatment so that said cold-rolled sheet has an amount of Fe in solid solution of not more than 250 ppm, an amount of Si in solid solution of not more than 150 ppm, and an amount of Cu in solid solution of not more than 120 ppm, whereby limiting the ranges of the Fe, Si and Cu in solid solution ensures uniformity of an electrolytic grained surface in said plate by providing for the uniform graining or pits.

2. The process according to claim 1, wherein said heat treatment is effected at a reduction in thickness of at least 93%.

3. A process according to claim 1, wherein said heat treatment is effected at a temperature of not lower than 250° C. but lower than 350° C.

4. A process according to claim 3, wherein said heat treatment is effected for two hours or longer.

5. A process according to claim 1, wherein said heat treatment is effected for two hours or longer.

6. The process according to claim 1, wherein the melt includes among the unavoidable impurities 0.01 to 0.04 wt % Ti or 0.0001 to 0.02 wt % B, and the ratio of Cu/Ti is not greater than 1.

7. The process according to claim 1, wherein the copper content is more than 0.001 wt % to 0.03 wt %.

8. A process of producing an aluminum alloy substrate for an electrolytically grainable lithographic printing plate said substrate capable of providing uniform graining or pits necessary for good printing quality using said plate, said process preventing occurrence of an unetched region and preventing the formation of pits having a diameter of at least 10 μm, said process comprising the steps of:

preparing a melt of an aluminum alloy consisting of 0.20 to 0.80 wt % of Fe and the balance of Al, grain-refining elements and unavoidable impurities and further consisting of 0.3 wt % or less of Si and 0.05 wt % or less of Cu;

continuously casting and rolling said melt to form a strip having a thickness of 20 mm or less; and cold-rolling said strip, with or without a preceding hot rolling, to form a cold-rolled sheet with a heat treatment at a temperature of 400° C. or higher effected either between passes of said cold rolling or after completion of said cold rolling and with a reduction in thickness of 91% or more given before said heat treatment so that said cold-rolled sheet has an amount of Fe in solid solution of not more than 250 ppm, an amount of Si in solid solution of not more than 150 ppm, and an amount of Cu in solid solution of not more than 120 ppm, whereby limiting the ranges of the Fe, Si and Cu in solid solution ensures uniformity of an electrolytic grained surface in said plate by providing for the uniform graining or pits.

9. A process according to claim 8, wherein said heat treatment is effected for two hours or longer.

10. The process according to claim 8, wherein the upper limit for the heat treatment is about 550° C.

11. The process according to claim 8, wherein said heat treatment is effected at a reduction in thickness of at least 93%.

12. The process according to claim 8, wherein the melt includes among the unavoidable impurities 0.01 to 0.04 wt % Ti or 0.0001 to 0.02 wt % B, and the ratio of Cu/Ti is not greater than 1.

13. The process according to claim 8, wherein the copper content is more than 0.001 wt % to 0.03 wt %.

* * * * *